United States Patent [19]

Suska

[11] Patent Number: 4,765,662

[45] Date of Patent: Aug. 23, 1988

[54] COORDINATED DOOR STOP AND LATCH

[76] Inventor: Charles R. Suska, R.R. 1 - Box 14, Roxbury, Conn. 06783

[21] Appl. No.: 947,601

[22] Filed: Dec. 30, 1986

[51] Int. Cl.[4] ..... E05C 15/02

[52] U.S. Cl. ..... 292/92; 292/DIG. 65; 292/219; 292/341.17; 292/254

[58] Field of Search ..... 292/254, 145, 137, 165, 292/140, 228, 219, 341.17, DIG. 65, 213, 218, 336.3, 92, 21

[56] References Cited

U.S. PATENT DOCUMENTS

| | | | |
|---|---|---|---|
| 466,186 | 12/1891 | Rohrbach | 292/165 |
| 897,749 | 9/1908 | Krafft | 292/145 |
| 1,904,291 | 4/1933 | Neilson et al. | 292/213 X |
| 3,042,435 | 7/1962 | Wieseler et al. | 292/213 |
| 3,172,168 | 3/1965 | Suska | 292/219 X |
| 3,220,759 | 11/1965 | Miller | 292/218 X |
| 3,862,774 | 1/1975 | Johnson | 292/228 |
| 3,946,460 | 3/1976 | Johnson | 292/DIG. 65 X |
| 4,081,980 | 4/1978 | Hightower | 292/140 X |
| 4,110,867 | 9/1978 | Gwozdz | 292/228 X |
| 4,216,986 | 8/1980 | McNinch et al. | 292/341.17 |
| 4,230,352 | 10/1980 | Sealey et al. | 292/341.17 |
| 4,271,691 | 6/1981 | Logan | 292/254 X |
| 4,669,282 | 6/1987 | Hoyt et al. | 292/DIG. 65 X |

*Primary Examiner*—Gary L. Smith
*Assistant Examiner*—Eric K. Nicholson
*Attorney, Agent, or Firm*—Brumbaugh, Graves, Donohue & Raymond

[57] ABSTRACT

A coordinated door stop and latch includes a retractable stop, a sliding bolt latch, and a mechanism between the stop and latch. The sliding bolt is used to latch the door to preclude inward movement in a normal fashion. If emergency outward operation of the door is required, retraction of the stop causes ejection of the sliding bolt from its strike opening, thereby enabling resuce door operation.

6 Claims, 2 Drawing Sheets

COORDINATED DOOR STOP AND LATCH

BACKGROUND OF THE INVENTION

Lavatory doors used in hospitals, nursing homes and the like are often mounted for bidirectional swinging movement. Normally the lavatory door swings inwardly and is prevented from swinging outwardly by a retractable door stop. To enable outward operation of the door, the so-called emergency or rescue door stop disclosed in Suska U.S. Pat. No. 3,172,168 has been widely used in hospitals and nursing facilities.

To retain the lavatory door in its closed position while the lavatory is being used, a roller latch or similar detent device has been employed with the emergency door stop. However, such latches must be forcibly retracted when the door is closed and then again retracted by applying force to open the door. Feeble patients find it difficult to operate doors equipped with such roller or detent latches.

Patients prefer a positive latch, for example a sliding bolt, to insure privacy. Such a latch affords the advantage of easy operation of both latch and door. However, in the past a sliding latch bolt has been incompatible with the conventional rescue door stop since the bolt defeats the purpose of the door stop. Thus if it becomes necessary to open the door outwardly by retracting the door stop, the latch bolt will retain the door in position and prevent rescue of the patient from the lavatory. Such rescue becomes necessary when an ill patient falls in the path of the normal inwardly swinging door. Hence in spite of the substantial user effort required, a disadvantage in the hospital environment, detent type latches have been used with rescue door stops.

Moreover, the cost and installation of the roller latch is greater than that of the simple surface mounted slide bolt, and surface mounted slide bolt latches can be applied to thinner and less expensive doors than detent latches.

BRIEF SUMMARY OF THE INVENTION

The present invention provides a coordinated door stop and latch comprising a preferred sliding bolt latch on the door in combination with a rescue door stop.

More particularly, a suitable mechanism is provided between the rescue door stop and the latch bolt so that operation of the stop to its retracted or rescue position automatically retracts the door bolt and enables outward operation of the lavatory door.

These and other features and advantages of the invention will be more readily understood when the following description is read in connection with the accompanying drawings.

DESCRIPTION OF EXEMPLARY EMBODIMENTS

Figure 1:
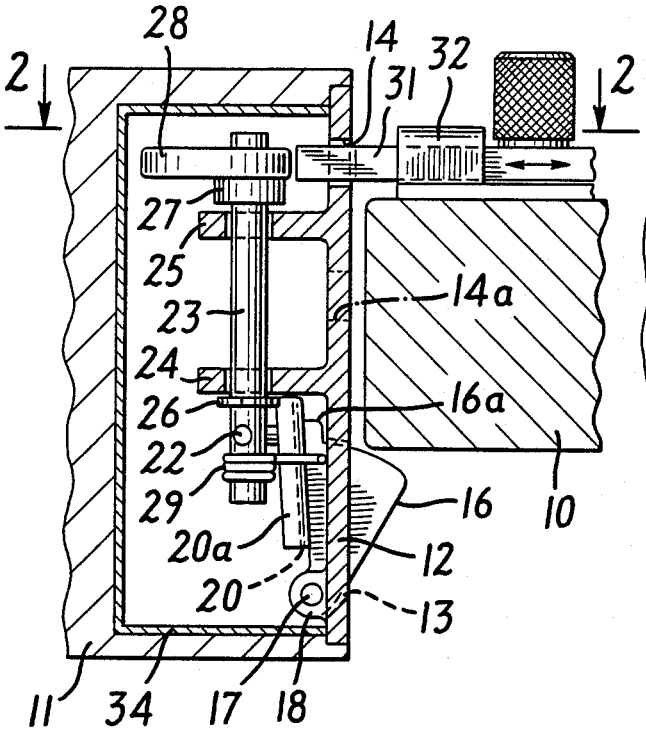
FIG. 1 is a plan view, partially in section, of the inventive apparatus.
Figure 2:
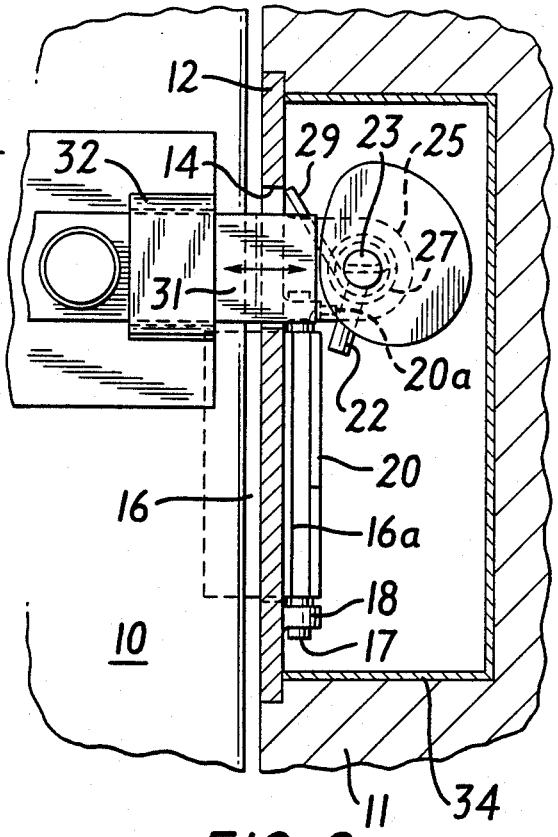
FIG. 2 is a side elevation, partially sectioned, taken along the view line 2—2 of FIG. 1.
Figure 3:
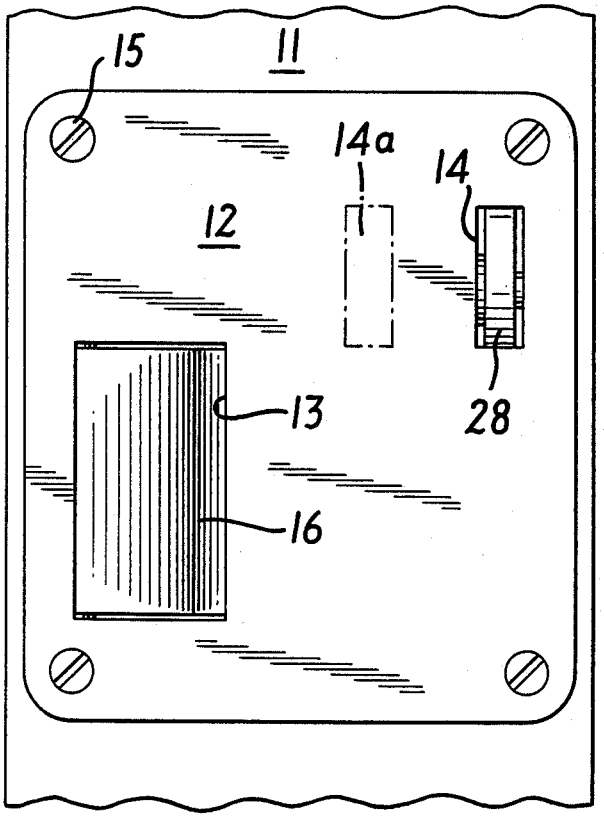
FIG. 3 is a front elevation showing the inventive apparatus mounted in a door frame.
Figure 4:
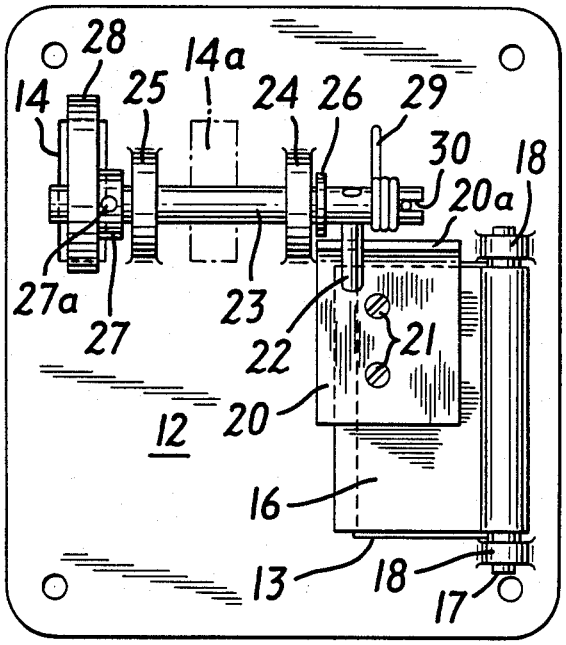
FIG. 4 is a rear elevation of the coordinated door stop mechanism with its cover removed.

Referring to the drawings in greater detail with particular reference to FIGS. 1–4, a door 10 is mounted in a frame 11 for bidirectional swinging movement. A coordinated door stop and latch mounted in the frame 11 and on the door 10 includes a mounting plate 12 provided with a stop opening 13 and a latch bolt opening or strike 14. Note that the strike 14 is positioned for use with a sliding latch that is surface mounted on the door 10. In the event a mortised bolt latch is used, an opening **14*a*, shown in broken lines, may be provided on the plate 12 to receive the bolt. Suitable screws 15 secure the device in a recess in the door frame 11**.

A stop 16 having a generally triangular shaped cross-section, similar to the retractable door stop disclosed in Suska U.S. Pat. No. 3,172,168, is pivotally connected to the mounting plate 12 by a pin 17 extending through stop 16 and journalled in ears 18 fastened to the plate. Travel of the stop 16 outwardly to its door engaging position is limited by a shoulder **16*a* engaging the right-hand edge of the opening 13 in the plate 12. Travel of the stop 16 inwardly may be limited, if desired, by lips projecting from the pivoted side of the stop to form shoulders engageable with the rear face of the mounting plate 12**, as shown in the above referred to Suska patent.

While a pivoted rescue door stop has been shown, it is apparent that a linearly movable slidable block could also serve as a door stop.

An L-shaped member 20, fastened by screws 21 to the rear face of the stop 16, includes a flange **20*a* that engages an arm 22 press fitted through an opening in a shaft 23**.

Lugs 24 and 25 mounted on the rear of the plate 12 journal the shaft 23. A retaining ring 26 on one side of the lug 24 and a cam hub 27 on the outer side of the lug 25 position the shaft 23 longitudinally. The shaft 23 is grooved to receive the ring 26 in a conventional manner. A cross-pin **27*a* pressed into a cross-hole in the shaft 23** retains the cam in position.

A cam 28 integral with the cam hub 27 is carried by the shaft 23 directly opposite the rectangular opening 14. This provides for cam interaction with a sliding bolt, as described hereinafter. However, if a bolt mortised into the door 10 is to be used, the cam is positioned to the right of the lug 25 opposite the opening **14*a* which, in that instance, will be cut in the plate 12. With that arrangement, the opening 14 need not be cut in the plate. An additional ring is then provided on the shaft left of the lug 25** to retain the shaft longitudinally in position.

The shaft also carries a torsion spring 29, an end of which is placed in a notch 30 at one end of the shaft 23. The notch is then partially closed to secure the spring to the shaft. The other end of the spring 29 bears against the back of the plate 12 to urge the shaft to rotate. Thus the arm 22 acts against the flange **20*a* of the L-shaped member 20 to bias the stop 16 outwardly of the plate 12**.

To enable a person to latch the normally inward swinging door, a latch bolt 31 is slidably mounted in a latch housing 32 mounted on the surface of the door 10.

The bolt 31 is aligned with the strike opening 14 and is readily operable by even feeble or ill persons. If the sliding bolt is mortised into the door 10, then a strike opening 14*a* on the plate 12 receives the bolt.

As earlier stated, the cam 28 is positioned on the shaft 23 in alignment with the strike opening 14. Note that the cam width is less than that of the opening 14 to provide clearance on each side of the cam when it is rotated into the opening. With the cam positioned angularly with respect to the arm 22, retraction of the stop 16, preparatory to swinging the door outwardly to its rescue or emergency position, causes rotation of the shaft 23 resulting in cam ejection of the bolt 31 out of the strike opening 14 by the cam 28. Thus outward operation of the door is permitted.

When the stop 16 is released, with the door in its rescue position, the shaft 23 is rotated by the spring 29. Such rotation causes the arm 22 to operate the stop 16 outwardly to its normal position through the opening 13 of the plate 12. Operation of the door toward its position in the frame 11 causes the door edge to engage the inclined surface of the stop 16, causing it to retract and permit the door to be returned to its normal position, as fully explained in the above-discussed Suska patent. The spring 29 then again returns the stop to its normal position. Note that the cam 28 is now displaced away from the strike opening 14 and the bolt 31 may be moved into the opening to secure the door.

A cover 34 extending from the plate 12 encloses the door stop mechanism. The cover is fastened to the plate in a manner similar to that shown in the above-mentioned Suska patent. With use of the cover 34, the coordinated stop and latch may be installed in a door jamb that is narrower than the stop mechanism. The strike side can be exposed, and if so, the strike side mounting holes are moved closer to the stop side of the plate 12. If desired, a localized widening block can be added onto the inner side of the jamb.

Figure 5:
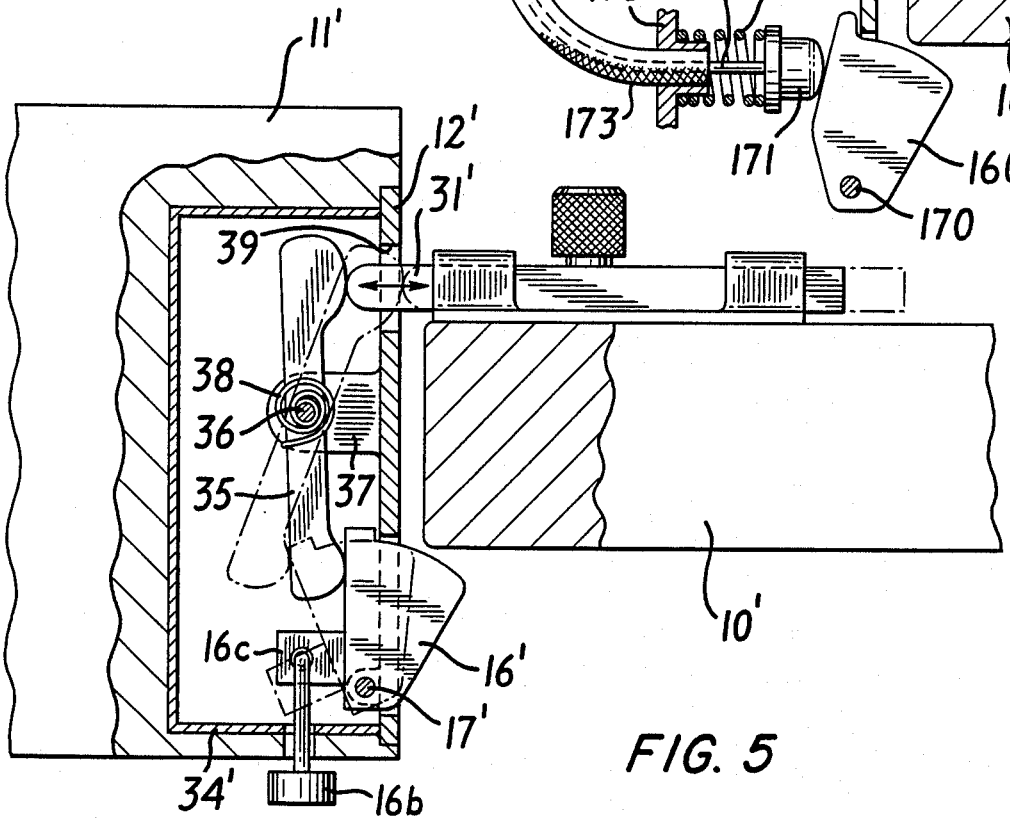
FIG. 5 is a plan view showing another embodiment of the inventive door stop and latch mounted on a door frame and door.

A modified embodiment of the inventive coordinated door stop and latch is shown in FIG. 5. Like parts have been designated by primed reference numerals. A stop 16' pivoted on a shaft 17' is mounted on a plate 12' adapted to be attached to a door frame 11' in a suitable opening. A knob 16*b* attached to a lug 16*c*, can be used to retract the stop 16'. Such operating knob can also be used, if desired, with the FIG. 1 and FIG. 7 embodiments of the invention. A lever 35 pivoted on a pin 36 carried by a lug 37 on the plate 12' is biased for counterclockwise rotation by a torsion spring 38. The other end of the lever 35 is adjacent to a strike opening 39. As shown, a bolt 31' in its latched position on a door 10' is juxtaposed to the end of the lever 35. A cover 34' encloses the door stop mechanism.

In operation, the stop 16' is manually retracted, through direct pressure on the stop 16' or by pulling the knob 16*b* outwardly to enable the door 10' to swing outwardly to its emergency or rescue position. This causes the lever 35 to rotate in a clockwise direction to its broken line position, thereby ejecting the bolt 31' from its opening 39 to unlock the door and permit the door to be swung outwardly.

Figure 6:
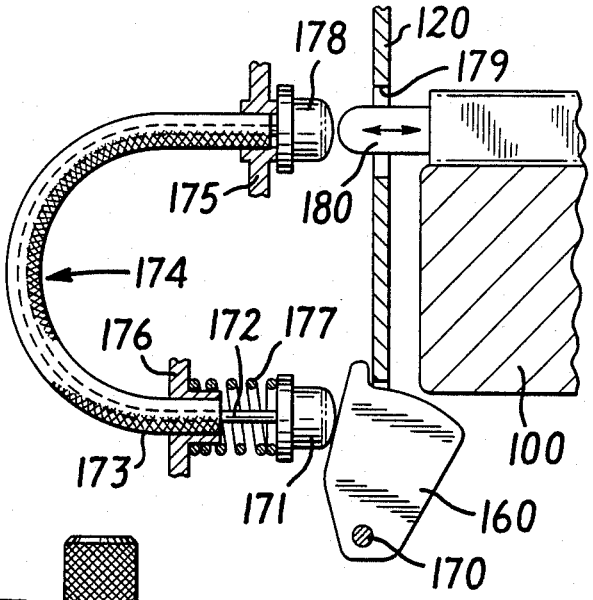
FIG. 6 is a plan view showing diagrammatically still another embodiment of the inventive door stop and latch.

Other mechanical couplings may be used between the stop and the bolt. Referring to FIG. 6, which shows another coupling in diagrammatic form, in the interests of simplicity, a stop 160, pivoted on a shaft 170 suitably secured to a mounting plate 120 (partially shown), engages an actuator 171 attached to a flexible wire 172 slidably carried by flexible tubing 173, the combination comprising a cable assembly 174 similar, for example, to cables used for bicycle brakes. The cable assembly 174 is mounted by supports 175 and 176 suitably secured to the mounting plate 120. A spring 177 biases the actuator 171 outwardly against the stop 160. The travel of the actuator is also limited by another actuator 178 on the other end of the flexible wire 172. The actuator 178 is adjacent to a strike opening 179 in the plate 120. A door 100 carries a slidable bolt 180, shown in its latched position, the bolt being juxtaposed to the actuator 178.

In operation, the stop 160 is manually retracted by pivoting it on the shaft 170 to enable the door 100 to swing outwardly to its emergency or rescue position. Pivoting of the stop 160 moves the actuator 171 and compresses the spring 177. The wire 172 propels the actuator 178 against the bolt 180, thereby ejecting it from the strike opening 179 to unlock the door 100 and permit it to swing to the rescue position.

Figure 7:
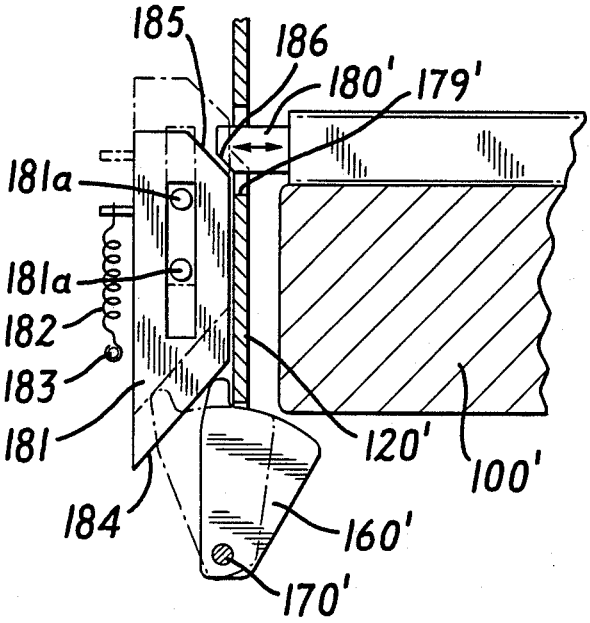
FIG. 7 is a plan view showing diagrammatically yet another embodiment of the inventive door stop and latch.

Still another form of mechanical coupling usable between the stop and the bolt is diagrammatically shown in FIG. 7. A stop 160' pivoted on a shaft 170' suitably secured to a mounting plate 120' (partially shown) engages a slide 181. A pair of pins 181*a* suitably secured to the mounting plate 120' guides the slide for travel between two positions, one of which is shown in full line and the other in broken line. A diagrammatically shown spring 182 attached to the slide and a fixed mount 183 biases the slide into the position shown to hold the stop 160' in its normal outward position. Inclined surfaces 184 and 185 on the slide respectively interact with the stop 160' and an inclined surface 186 on a bolt 180' mounted on a door 100'. The bolt protrudes through a strike opening 179' in the plate 120'.

In operation, when the stop 160' is manually pivoted, to permit the door 100' to be moved to its emergency or rescue position, the slide 181 is moved upwardly by a camming action of the stop 160' against the surface 184. This causes the inclined surfaces 185 and 186 to cam the bolt toward its open position in the strike opening 179'. The bolt 180' will be substantially ejected from the strike opening by it camming by the slide. However, if a small portion remains in the strike opening, when the door 100' is pulled toward the rescue position, the inclined surface 186 will engage the lower edge of the strike opening 179', thereby further retracting the bolt and enabling the door to be opened to its rescue position.

While the invention has been described with reference to specific embodiments, it will be understood that various changes and modifications may be made within the scope of the invention which is defined in the appended claims.

I claim:

1. A door stop and latch for a bidirectional swinging door comprising a mounting plate fastened to a frame adjacent to a latch edge of the door, door stop means mounted on the plate for movement from a normal door engaging position to a retracted position which permits movement of the door from a normally closed position to a rescue position, resilient means urging the door means stop to its normal door engaging position to engage one side of the door and locate the door in its normally closed position and prevent the door from swinging to the rescue position, a sliding bolt latch mounted on the other side of the door operable between unlatched and latched positions to latch the door selectively in its closed position, means responsive to movement of the door stop means from its normal door engaging position to its retracted position to slide the bolt from its latched position to its unlatched position, whereby operation of the door stop means to its retracted position will unlatch the door and permit it to be operated in its rescue position.

2. A door stop and latch as defined in claim 1, in which the means responsive to movement of the door stop means comprises a rotatable shaft mounted on the plate, an arm extending from the shaft and engaging the door stop means, a cam or eccentric mounted on the shaft in a position juxtaposed to the sliding bolt, resilient means rotatably biasing the shaft to cause the arm to urge the door stop to its door engaging position, whereby movement of the door stop means to its retracted position rotates the shaft and causes the cam to eject the sliding bolt from its latched position.

3. A door stop and latch as defined in claim 1, in which the means responsive to movement of the door stop means comprises a lever pivoted on the plate, one lever end positioned adjacent to the door stop meams and the other lever end positioned adjacent to the sliding bolt, resilient means biasing the lever to cause the one lever end to urge the door stop means to its door engaging position, whereby movement of the door stop means to its retracted position causes the door stop means to pivot the lever which, in turn, engages and ejects the sliding bolt from its latched position.

4. A door stop and latch defined in claim 1, in which the means responsive to movement of the door stop means comprises a cable assembly including a flexible wire having a first actuator at one end positioned adjacent to the stop means and a second actuator at the other end positioned adjacent to the sliding bolt, resilient means biasing the first actuator to cause it to urge the door stop means to its door engaging position, whereby movement of the door stop means to its retracted position causes the door stop means to move the actuator and flexible wire to cause the other actuator to eject the sliding bolt from its latched position.

5. A door stop and latch as defined in claim 1, in which the means responsive to movement of the door stop means comprises a slide mounted for linear movement, the ends of the slide having inclined cam surfaces adjacent to the stop means and the bolt, the bolt having an inclined surface complementary to the inclined surface on the slide, resilient means biasing the slide to cause it to urge the door stop means to its door engaging position, whereby movement of the door stop means to its retracted position causes it to cam and linearly move the slide which in turn cams and ejects the sliding bolt from its latched position.

6. A door stop and latch as defined in claim 1, 2, 3, or 5, in which a knob is attached to the door stop means for moving it from its normal position to its retracted position.

* * * * *